US011675309B2

(12) United States Patent
Shimadu

(10) Patent No.: US 11,675,309 B2
(45) Date of Patent: Jun. 13, 2023

(54) IMAGE FORMING APPARATUS CAPABLE OF READING DATA OF DRUM CARTRIDGE AND DATA OF TONER CARTRIDGE THROUGH BOARD OF TONER CARTRIDGE

(71) Applicant: BROTHER KOGYO KABUSHIKI KAISHA, Nagoya (JP)

(72) Inventor: Michihiro Shimadu, Toyota (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/684,477

(22) Filed: Mar. 2, 2022

(65) Prior Publication Data

US 2022/0187761 A1 Jun. 16, 2022

Related U.S. Application Data

(63) Continuation of application No. PCT/JP2020/035453, filed on Sep. 18, 2020.

(30) Foreign Application Priority Data

Sep. 30, 2019 (JP) ..... JP2019-178932

(51) Int. Cl.
*G03G 15/00* (2006.01)
*G03G 21/18* (2006.01)
*G03G 21/16* (2006.01)

(52) U.S. Cl.
CPC ..... *G03G 21/1885* (2013.01); *G03G 21/1652* (2013.01); *G03G 21/1867* (2013.01)

(58) Field of Classification Search
CPC ..... G03G 15/00; G03G 21/1652; G03G 21/1867; G03G 21/1885
(Continued)

(56) References Cited

U.S. PATENT DOCUMENTS 7,986,897 B2 * 7/2011 Nishimura ..... G03G 21/1821 399/90
10,852,685 B2 * 12/2020 Kishi ..... G03G 21/1821
(Continued)

FOREIGN PATENT DOCUMENTS

JP 2003-323098 A 11/2003
JP 2009-55588 A 3/2009
(Continued)

OTHER PUBLICATIONS

International Preliminary Report on Patentability issued in corresponding International Patent Application No. PCTIJP2020/035453, dated Apr. 14, 2022.
(Continued)

*Primary Examiner* — Hoan H Tran
(74) *Attorney, Agent, or Firm* — Merchant & Gould P.C.

(57) ABSTRACT

An image forming apparatus includes: a drum cartridge; a toner cartridge; a toner data electrical contact surface; a drum data electrical contact surface; and a controller. The drum cartridge includes: a drum memory storing data relating to the drum cartridge; and a first drum electrical contact for communication of data stored in the drum memory. The toner cartridge includes a board having: a first relay electrical contact for relaying the data stored in the drum memory; a toner memory storing data relating to the toner cartridge; and a first toner electrical contact for communication of data stored in the toner memory. The controller is configured to: read the data stored in the drum memory through the drum data electrical contact surface contacting the first relay electrical contact; and read the data stored in the toner memory through the toner data electrical contact surface contacting the first toner electrical contact.

5 Claims, 4 Drawing Sheets

(58) Field of Classification Search
USPC ..... 399/75, 90, 110, 111
See application file for complete search history.

(56) References Cited

U.S. PATENT DOCUMENTS

| | | | | |
|---|---|---|---|---|
| 10,859,941 | B2 * | 12/2020 | Kyotani | G03G 21/1821 |
| 11,099,501 | B2 * | 8/2021 | Kiriyama | G03G 15/80 |
| 2009/0034021 | A1 | 2/2009 | Taki et al. | |
| 2013/0108282 | A1 | 5/2013 | Sonoda et al. | |
| 2019/0196361 | A1 | 6/2019 | Kyotani | |
| 2019/0278221 | A1 | 9/2019 | Saeki | |

FOREIGN PATENT DOCUMENTS

| | | | |
|---|---|---|---|
| JP | 2013-97069 | A | 5/2013 |
| JP | 2013-218199 | A | 10/2013 |
| JP | 2019-117343 | A | 7/2019 |
| JP | 2019-159048 | A | 9/2019 |
| JP | 2021056374 | * | 4/2021 |

OTHER PUBLICATIONS

International Search Report issued in related PCT/JP2020/035453, dated Dec. 15, 2020.

* cited by examiner

IMAGE FORMING APPARATUS CAPABLE OF READING DATA OF DRUM CARTRIDGE AND DATA OF TONER CARTRIDGE THROUGH BOARD OF TONER CARTRIDGE

CROSS REFERENCE TO RELATED APPLICATIONS

This is a by-pass continuation application of International Application No. PCT/JP2020/035453 filed Sep. 18, 2020 claiming priority from Japanese Patent Application No. 2019-178932 filed Sep. 30, 2019. The entire contents of the International Application and the priority application are incorporated herein by reference.

BACKGROUND

Conventionally, there has been known an image forming apparatus to which a toner cartridge and a drum cartridge are detachably attachable. In this image forming apparatus, a storage medium is provided at each of the toner cartridge and the drum cartridge, and data can be read from each of the toner cartridge and the drum cartridge through the storage media.

SUMMARY

In the conventional image forming apparatus described above, an electrical contact for reading data of the toner cartridge and an electrical contact for reading data of the drum cartridge are individually provided, thereby causing increasing in size of the component for reading data.

In view of the foregoing, it is an object of the present disclosure to provide an image forming apparatus in which a component for reading data of a toner cartridge and data of a drum cartridge can be made compact.

In order to attain the above and other objects, according to one aspect, the present disclosure provides an image forming apparatus including: a drum cartridge; a toner cartridge; a toner data electrical contact surface; a drum data electrical contact surface; and a controller. The drum cartridge includes: a photosensitive drum; a drum memory; and a first drum electrical contact for communication of data stored in the drum memory. The drum memory stores therein data relating to the drum cartridge. The first drum electrical contact is electrically connected to the drum memory. The toner cartridge includes: a casing; and a board. The casing is configured to accommodate toner therein. The board includes: a first electrical contact; a first relay electrical contact for relaying the data stored in the drum memory; a toner memory; and a first toner electrical contact for communication of data stored in the toner memory. The first electrical contact makes contact with the first drum electrical contact. The first relay electrical contact is electrically connected to the first electrical contact. The toner memory stores therein data relating to the toner cartridge. The first toner electrical contact is electrically connected to the toner memory. The toner data electrical contact surface makes contact with the first toner electrical contact. The drum data electrical contact surface makes contact with the first relay electrical contact. The controller is configured to: read the data stored in the drum memory through the drum data electrical contact surface; and read the data stored in the toner memory through the toner data electrical contact surface.

With this configuration, the controller can read data stored in the drum memory through the first relay electrical contact provided at the board of the toner cartridge and the drum data electrical contact surface. Accordingly, not only data stored in the toner memory but also data stored in the drum memory can be read through the board of the toner cartridge, whereby the component for reading data of the toner cartridge and data of the drum cartridge can be made compact.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
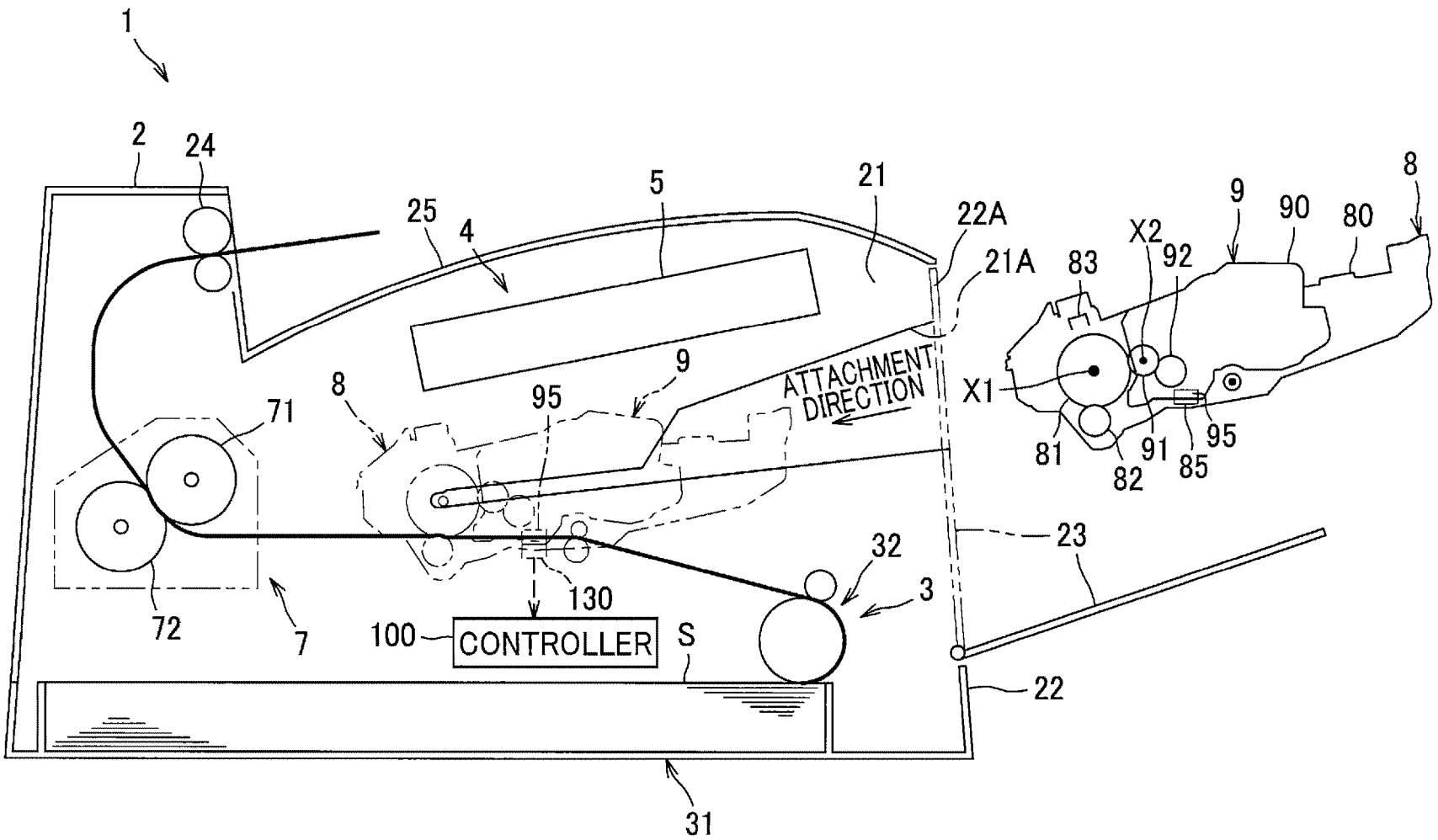
FIG. 1 is a schematic diagram of an image forming apparatus.

Next, one embodiment of the present disclosure will be described in detail while referring to the accompanying drawings. As illustrated in FIG. 1, an image forming apparatus 1 mainly includes a main body 2, a feeding unit 3 for feeding a sheet(s) S to an inside of the main body 2, an image forming unit 4 for forming an image on the sheet S, a controller 100, and a main body connector 130. The image forming apparatus 1 is a monochromatic laser printer.

The main body 2 is in a form of a hollow case. The main body 2 includes a pair of right and left side walls 21, and a front wall 22 connecting the side walls 21 to each other. A guide groove 21A is formed at each of the side walls 21 to guide a drum cartridge 8 (described later). The front wall 22 has a main opening 22A. A front cover 23 is provided at the front wall 22 so as to be pivotally movable frontward and rearward for opening and closing the main opening 22A. Each of the guide grooves 21A extends from the inside of the main body 2 to the main opening 22A.

The feeding unit 3 includes a sheet tray 31 detachably attached to a lower portion of the main body 2, and a feeding mechanism 32 configured to feed the sheet(s) S in the sheet tray 31 toward the image forming unit 4.

The image forming unit 4 includes a scanner unit 5, a fixing unit 7, the drum cartridge 8, and a toner cartridge 9.

The scanner unit 5 is provided at an upper portion within the main body 2, and includes a laser-emitting unit, a polygon mirror, lenses, and a reflecting mirror those are not illustrated. In the scanner unit 5, a surface of a photosensitive drum 81 (described later) is irradiated with laser beam by high-speed scanning.

The controller 100 includes, for example, a CPU, a RAM, a ROM, and an input/output circuit. The controller 100 is configured to execute printing control by performing arithmetic processing based on data of attached cartridges and programs and data stored in the ROM.

The main body connector 130 is provided at one of the side walls 21 of the main body 2. The main body connector 130 is positioned below the guide groove 21A of the one of the side walls 21. The main body connector 130 communicates with a drum memory 86 and a toner memory 96 those will be described later to transmit data stored in the drum memory 86 and the toner memory 96 to the controller 100.

The drum cartridge 8 is positioned between the feeding unit 3 and the scanner unit 5. The drum cartridge 8 is attachable to the main body 2 in an attachment direction through the main opening 22A opened and closed by the front cover 23 of the main body 2. The drum cartridge 8 is attachable to the main body 2 along the guide grooves 21A formed at the main body 2. In other words, the attachment direction is a direction that is along the guide grooves 21A.

In the present embodiment, the drum cartridge 8 is attachable to the image forming apparatus 1 in a state where the toner cartridge 9 is attached to the drum cartridge 8.

The drum cartridge 8 includes a frame 80 to which the toner cartridge 9 is attachable, the photosensitive drum 81, a transfer roller 82, a charger 83, and a drum board 85. The photosensitive drum 81 is rotatable about a first axis X1 extending in an axial direction. The axial direction crosses the attachment direction. In the present embodiment, the axial direction is orthogonal to the attachment direction.

Figure 2:
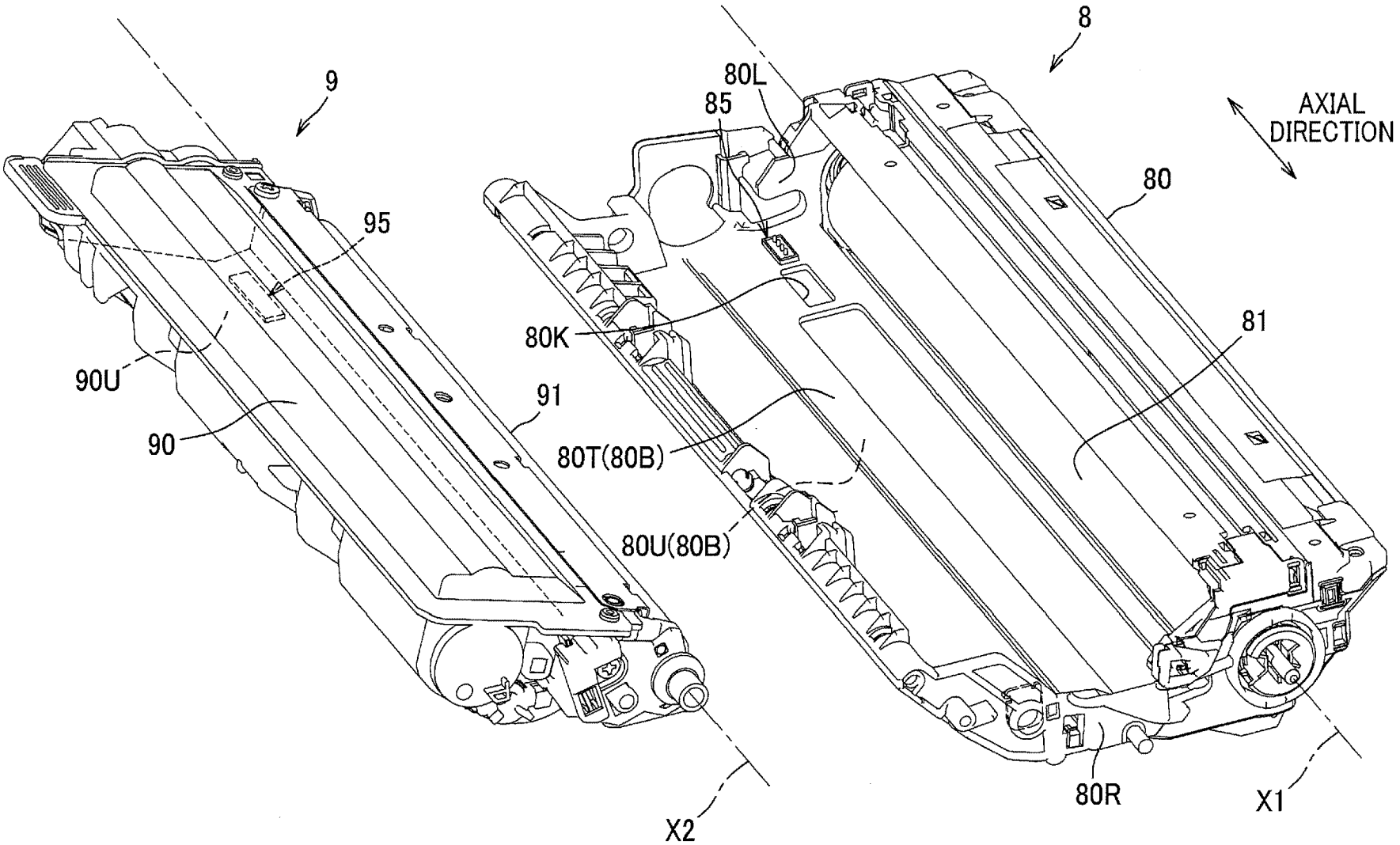
FIG. 2 is a perspective view of a drum cartridge and a toner cartridge.

As illustrated in FIG. 2, the frame 80 includes a first side frame 80L, a second side frame 80R, and a bottom frame 80B. The first side frame 80L is positioned at one end portion in the axial direction of the frame 80. The second side frame 80R is positioned at another end portion in the axial direction of the frame 80. The first side frame 80L and the second side frame 80R cross the axial direction. The toner cartridge 9 is attachable between the first side frame 80L and the second side frame 80R.

The bottom frame 80B connects the first side frame 80L and the second side frame 80R to each other. The bottom frame 80B has a first surface 80T, a second surface 80U, and an opening 80K. The first surface 80T is a surface that faces the toner cartridge 9 in a state where the toner cartridge 9 is attached to the frame 80. The second surface 80U is a surface opposite the first surface 80T. The opening 80K has a rectangular shape. The opening 80K is positioned at one end portion in the axial direction of the bottom frame 80B.

The drum board 85 is positioned at the first surface 80T of the frame 80. The drum board 85 is positioned at the one end portion in the axial direction of bottom frame 80B, and aligned with the opening 80K in the axial direction. When the toner cartridge 9 is attached to the drum cartridge 8, the drum board 85 faces the toner cartridge 9.

As illustrated in FIG. 1, the toner cartridge 9 includes a casing 90 configured to accommodate toner therein, a developing roller 91, a supply roller 92, and a toner board 95 as an example of a board. The developing roller 91 is rotatable about a second axis X2 extending in the axial direction. The developing roller 91 is configured to supply toner to the photosensitive drum 81. The supply roller 92 is configured to supply toner in the casing 90 to the developing roller 91.

As illustrated in FIG. 2, the toner board 95 is positioned at one end portion in the axial direction of a toner bottom surface 90U of the casing 90. The toner bottom surface 90U is a surface that faces the bottom frame 80B when the toner cartridge 9 is attached to the drum cartridge 8. When the toner cartridge 9 is attached to the drum cartridge 8, a part of the toner board 95 faces the drum board 85, and another part of the toner board 95 is exposed through the opening 80K. When the drum cartridge 8 to which the toner cartridge 9 is attached is attached to the main body 2, the other part of the toner board 95 which is exposed through the opening 80K faces the main body connector 130.

In the drum cartridge 8, the surface of the photosensitive drum 81 is uniformly charged by the charger 83, and exposed to light with laser beam emitted from the scanner unit 5 by high-speed scanning. Through this operation, an electrical potential of a portion of the photosensitive drum 81 which is exposed to light is lowered, and an electrostatic latent image is formed on the surface of the photosensitive drum 81 based on image data.

Thereafter, toner in the toner cartridge 9 is supplied by the developing roller 91 which is rotating to the electrostatic latent image on the photosensitive drum 81 to form a toner image on the surface of the photosensitive drum 81. Then, a sheet S is conveyed between the photosensitive drum 81 and the transfer roller 82. As a result, the toner image carried on the surface of the photosensitive drum 81 is transferred onto the sheet S.

The fixing unit 7 includes a heating roller 71 and a pressure roller 72. The pressure roller 72 faces the heating roller 71 to press the heating roller 71. At the fixing unit 7 as configured above, the toner transferred onto the sheet S is thermally fixed to the sheet S as the sheet S passes between the heating roller 71 and the pressure roller 72.

The sheet S to which the toner is thermally fixed at the fixing unit 7 is conveyed to a discharge roller 24 positioned at the downstream side of the fixing unit 7, and is discharged onto a discharge tray 25 through the discharge roller 24.

Next, configurations of the main body connector 130, the drum board 85, and the toner board 95 will be described with reference to FIGS. 3 and 4.

Figure 3:
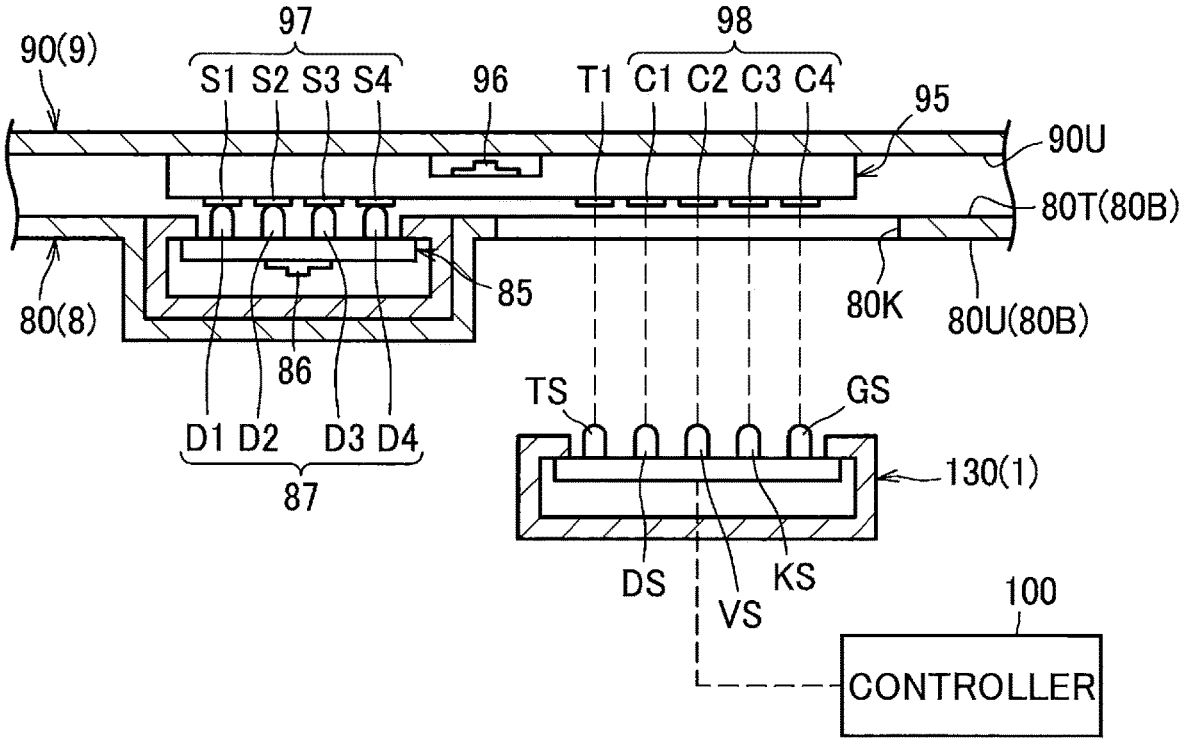
FIG. 3 is a cross-sectional view of a main body connector, a toner board, and a drum board.

As illustrated in FIG. 3, the drum board 85 includes the drum memory 86, and drum electrical contacts 87. In the present embodiment, the drum electrical contacts 87 are configured of four electrical contacts, namely, a first drum electrical contact D1, a second drum electrical contact D2, a third drum electrical contact D3, and a fourth drum electrical contact D4.

The drum memory 86 is a storage element and stores therein data relating to the drum cartridge 8. For example, product information of the drum cartridge 8 is stored in the drum memory 86.

Specifically, at least one of drum identification information and drum lifetime information is stored in the drum memory 86. The drum identification information is information used to identify an individual drum cartridge 8, and for example, is a serial number. The drum lifetime information is information relating to a lifetime of the drum cartridge 8. The drum lifetime information is, for example, at least one of: the cumulative number of rotations of the photosensitive drum 81; the cumulative number of sheets printed using the photosensitive drum 81; and the cumulative number of dots formed using the photosensitive drum 81.

In the present embodiment, the cumulative number of rotations of the photosensitive drum 81, the cumulative number of sheets printed using the photosensitive drum 81, and the cumulative number of dots formed using the photosensitive drum 81 are stored in the drum memory 86 as the drum lifetime information.

The first drum electrical contact D1 is electrically connected to the drum memory 86. The first drum electrical contact D1 is an electrical contact for communication of data stored in the drum memory 86.

The second drum electrical contact D2 is electrically connected to the drum memory 86. The second drum electrical contact D2 is an electrical contact for supplying electrical power to the drum memory 86.

The third drum electrical contact D3 is electrically connected to the drum memory 86. The third drum electrical contact D3 is an electrical contact for transmitting a clock signal to the drum memory 86.

The fourth drum electrical contact D4 is electrically connected to the drum memory 86. The fourth drum electrical contact D4 is an electrical contact for grounding the drum memory 86.

The toner board 95 includes the toner memory 96, electrical contacts 97, a first toner electrical contact T1, and relay electrical contacts 98.

In the present embodiment, the electrical contacts 97 are configured of four electrical contacts, namely, a first electrical contact S1, a second electrical contact S2, a third electrical contact S3, and a fourth electrical contact S4. In the present embodiment, the relay electrical contacts 98 are configured of four electrical contacts, specifically, a first relay electrical contact C1, a second relay electrical contact C2, a third relay electrical contact C3, and a fourth relay electrical contact C4.

The toner memory 96 is a storage element. The toner memory 96 stores therein data relating to the toner cartridge 9. For example, product information of the toner cartridge 9 is stored in the toner memory 96. Further, toner identification information used to identify an individual toner cartridge 9 is stored in the toner memory 96, for example.

The first electrical contact S1 is an electrical contact that makes contact with the first drum electrical contact D1 when the toner cartridge 9 is attached to the drum cartridge 8.

The second electrical contact S2 is an electrical contact that makes contact with the second drum electrical contact D2 when the toner cartridge 9 is attached to the drum cartridge 8.

The third electrical contact S3 is an electrical contact that makes contact with the third drum electrical contact D3 when the toner cartridge 9 is attached to the drum cartridge 8.

The fourth electrical contact S4 is an electrical contact that makes contact with the fourth drum electrical contact D4 when the toner cartridge 9 is attached to the drum cartridge 8.

The first toner electrical contact T1 is electrically connected to the toner memory 96. The first toner electrical contact T1 is an electrical contact for communication of data stored in the toner memory 96.

The first relay electrical contact C1 is electrically connected to the first electrical contact S1. The first relay electrical contact C1 is an electrical contact for relaying the data stored in the drum memory 86.

Figure 4:
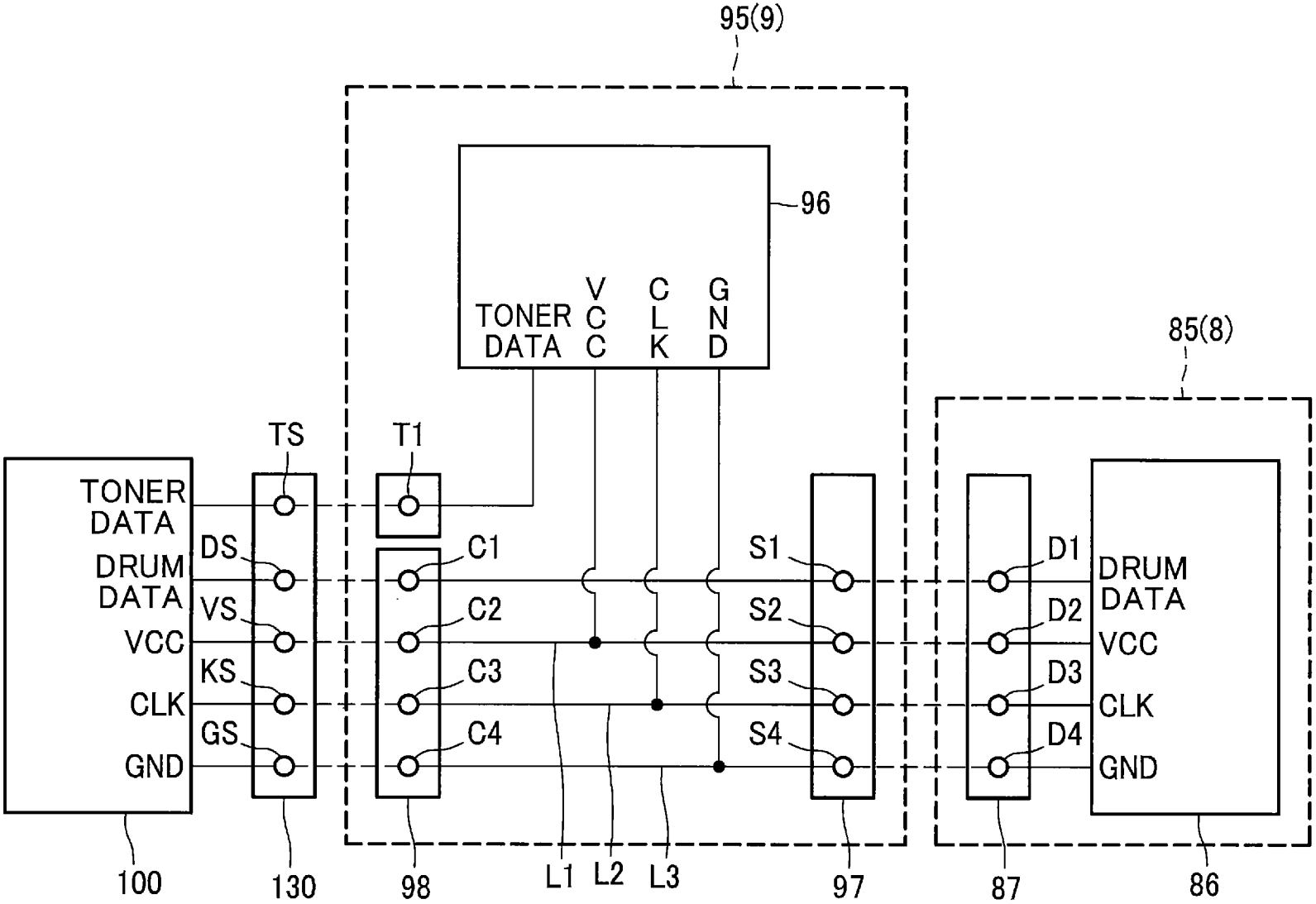
FIG. 4 is a circuit diagram illustrating connection among the main body connector, the toner board, and the drum board.

The second relay electrical contact C2 is electrically connected to both the toner memory 96 and the second electrical contact S2 through a first wiring L1 (see FIG. 4). That is, the first wiring L1 electrically connects the toner memory 96 and the second relay electrical contact C2 to each other while the first wiring L1 electrically connects the second electrical contact S2 and the second relay electrical contact C2 to each other. The second relay electrical contact C2 is an electrical contact for supplying electrical power to the drum memory 86 and the toner memory 96.

The third relay electrical contact C3 is electrically connected to both the toner memory 96 and the third electrical contact S3 through a second wiring L2 (see FIG. 4). That is, the second wiring L2 electrically connects the toner memory 96 and the third relay electrical contact C3 to each other while the second wiring L2 electrically connects the third electrical contact S3 and the third relay electrical contact C3 to each other. The third relay electrical contact C3 is an electrical contact for transmitting a clock signal to the drum memory 86 and the toner memory 96.

The fourth relay electrical contact C4 is electrically connected to both the toner memory 96 and the fourth electrical contact S4 through a third wiring L3 (see FIG. 4). That is, the third wiring L3 electrically connects the toner memory 96 and the fourth relay electrical contact C4 to each other while the third wiring L3 electrically connects the fourth electrical contact S4 and the fourth relay electrical contact C4 to each other. The fourth relay electrical contact C4 is an electrical contact for grounding the drum memory 86 and the toner memory 96.

In the present embodiment, the main body connector 130 has five electrical contact surfaces. Specifically, the main body connector 130 has a toner data electrical contact surface TS, a drum data electrical contact surface DS, a power source electrical contact surface VS, a clock signal electrical contact surface KS, and a ground electrical contact surface GS.

When the drum cartridge 8 to which the toner cartridge 9 is attached is attached to the main body 2, the toner data electrical contact surface TS makes contact with the first toner electrical contact T1. The controller 100 can read the data stored in the toner memory 96 through the toner data electrical contact surface TS.

When the drum cartridge 8 to which the toner cartridge 9 is attached is attached to the main body 2, the drum data electrical contact surface DS makes contact with the first relay electrical contact C1. The controller 100 can read the data stored in the drum memory 86 through the drum data electrical contact surface DS.

When the drum cartridge 8 to which the toner cartridge 9 is attached is attached to the main body 2, the power source electrical contact surface VS makes contact with the second relay electrical contact C2. Electrical power is supplied to the drum memory 86 and the toner memory 96 through the first wiring L1 and the power source electrical contact surface VS.

When the drum cartridge 8 to which the toner cartridge 9 is attached is attached to the main body 2, the clock signal electrical contact surface KS makes contact with the third relay electrical contact C3. The controller 100 can transmit a clock signal to the drum memory 86 and the toner memory 96 through the second wiring L2 and the clock signal electrical contact surface KS.

When the drum cartridge 8 to which the toner cartridge 9 is attached is attached to the main body 2, the ground electrical contact surface GS makes contact with the fourth relay electrical contact C4. The drum memory 86 and the toner memory 96 are grounded through the third wiring L3 and the ground electrical contact surface GS.

Next, description will be made as to functions and advantageous effects of the image forming apparatus 1 described above.

According to the image forming apparatus 1 of the present disclosure, the controller 100 can read the data stored in the drum memory 86 through the first relay electrical contact C1 provided at the toner board 95 of the toner cartridge 9 and the drum data electrical contact surface DS. Accordingly, the controller 100 can read not only the data stored in the toner memory 96, but also the data stored in the drum memory 86 through the toner board 95 of the toner cartridge 9. As a result, the component for reading the data of the toner cartridge 9 and the data of the drum cartridge 8, that is, the main body connector 130 in the present embodiment can be made compact.

Furthermore, the toner board 95 includes the second relay electrical contact C2 and the first wiring L1. Thus, electrical power can be supplied to both the toner memory 96 and the drum memory 86 as long as the main body connector 130 has one power source electrical contact surface VS. Therefore, downsizing of the main body connector 130 can be achieved.

Furthermore, the toner board 95 includes the third relay electrical contact C3 and the second wiring L2. Thus, a clock signal can be transmitted to both the toner memory 96 and the drum memory 86 as long as the main body connector 130 has one clock signal electrical contact surface KS, thereby enabling downsizing of the main body connector 130.

Furthermore, the toner board 95 includes the fourth relay electrical contact C4 and the third wiring L3. Thus, both the toner memory 96 and the drum memory 86 can be grounded as long as the main body connector 130 has one ground electrical contact surface GS. As a result, the main body connector 130 can be further downsized.

While the description has been made with reference to the embodiment of the present disclosure, it would be apparent to those skilled in the art that the present disclosure is not limited to the above embodiment and various changes and modifications may be made to the specific configuration in the embodiment.

In the above-described embodiment, the configuration in which the controller reads data from the drum memory and the toner memory is described. However, the controller may also write data into the drum memory and the toner memory, not only reading data from the drum memory and the toner memory. In this case, data such as the cumulative number of sheets printed by image formation, the cumulative number of dots counted, the cumulative number of rotations of the photosensitive drum, the cumulative number of sheets printed using the developing roller, and the like are written into the drum memory and the toner memory, for example.

In the above-described embodiment, the toner cartridge is attached to the image forming apparatus while the toner cartridge is attached to the drum cartridge. However, the toner cartridge and the drum cartridge may be individually attached to the image forming apparatus. In addition, although the toner cartridge includes the developing roller in the above-described embodiment, the toner cartridge need not include the developing roller. In this case, the drum cartridge may include the developing roller.

In the above-described embodiment, the image forming apparatus is a monochromatic laser printer. However, the image forming apparatus may be a color image forming apparatus, or may be an image forming apparatus in which an exposure process is performed by an LED, or may be a copying machine or a multifunction peripheral.

The elements described in the above embodiment and modifications can be implemented in any suitable combination.

What is claimed is:

1. An image forming apparatus comprising:

a drum cartridge including:

a photosensitive drum;

a drum memory storing therein data relating to the drum cartridge; and a first drum electrical contact for communication of data stored in the drum memory, the first drum electrical contact being electrically connected to the drum memory;

a toner cartridge including:

a casing configured to accommodate toner therein; and a board including:

a first electrical contact making contact with the first drum electrical contact;

a first relay electrical contact for relaying the data stored in the drum memory, the first relay electrical contact being electrically connected to the first electrical contact;

a toner memory storing therein data relating to the toner cartridge; and a first toner electrical contact for communication of data stored in the toner memory, the first toner electrical contact being electrically connected to the toner memory;

a toner data electrical contact surface making contact with the first toner electrical contact;

a drum data electrical contact surface making contact with the first relay electrical contact; and a controller configured to:

read the data stored in the drum memory through the drum data electrical contact surface; and read the data stored in the toner memory through the toner data electrical contact surface.

2. The image forming apparatus according to claim 1, wherein the drum cartridge further includes a second drum electrical contact for supplying electrical power to the drum memory, wherein the board further includes:

a second electrical contact making contact with the second drum electrical contact;

a second relay electrical contact for supplying electrical power to the drum memory and the toner memory; and a first wiring electrically connecting the toner memory and the second relay electrical contact to each other while electrically connecting the second electrical contact and the second relay electrical contact to each other, the image forming apparatus further comprising a power source electrical contact surface making contact with the second relay electrical contact, wherein electrical power is supplied to the drum memory and the toner memory through the power source electrical contact surface.

3. The image forming apparatus according to claim 1, wherein the drum cartridge further includes a third drum electrical contact for transmitting a clock signal to the drum memory, wherein the board further includes:

a third electrical contact making contact with the third drum electrical contact;

a third relay electrical contact for transmitting a clock signal to the drum memory and the toner memory; and a second wiring electrically connecting the toner memory and the third relay electrical contact to each other while electrically connecting the third electrical contact and the third relay electrical contact to each other, the image forming apparatus further comprising a clock signal electrical contact surface making contact with the third relay electrical contact, wherein the controller is further configured to transmit a clock signal to the drum memory and the toner memory through the clock signal electrical contact surface.

4. The image forming apparatus according to claim 1, wherein the drum cartridge further includes a fourth drum electrical contact for grounding the drum memory, wherein the board further includes:

a fourth electrical contact making contact with the fourth drum electrical contact;

a fourth relay electrical contact for grounding the drum memory and the toner memory; and a third wiring electrically connecting the toner memory and the fourth relay electrical contact to each other while electrically connecting the fourth electrical contact and the fourth relay electrical contact to each other, the image forming apparatus further comprising a ground electrical contact surface making contact with the fourth relay electrical contact surface, wherein the drum memory and the toner memory are grounded through the ground electrical contact surface.

5. The image forming apparatus according to claim 1, wherein the drum cartridge further includes a frame to which the toner cartridge is attachable, and wherein the drum cartridge is attachable to the image forming apparatus in a state where the toner cartridge is attached to the drum cartridge.

* * * * *